US012760552B2

(12) United States Patent
Tollefson

(10) Patent No.: US 12,760,552 B2
(45) Date of Patent: Oct. 13, 2026

(54) SHUTTER MOUNTING SYSTEM

(71) Applicant: Eickhof Columbaria, Inc., Crookston, MN (US)

(72) Inventor: Peter Tollefson, Crookston, MN (US)

(73) Assignee: EICKHOF COLUMBARIA, INC., Crookston, MN (US)

( * ) Notice: Subject to any disclaimer, the term of this patent is extended or adjusted under 35 U.S.C. 154(b) by 274 days.

(21) Appl. No.: 18/520,128

(22) Filed: Nov. 27, 2023

(65) Prior Publication Data

US 2024/0175286 A1 May 30, 2024

Related U.S. Application Data

(60) Provisional application No. 63/385,132, filed on Nov. 28, 2022.

(51) Int. Cl.
*E04H 13/00* (2006.01)

(52) U.S. Cl.
CPC ..... *E04H 13/006* (2013.01); *E04H 13/001* (2013.01)

(58) Field of Classification Search
CPC ..... E04H 13/006; E04H 13/001
See application file for complete search history.

(56) References Cited

U.S. PATENT DOCUMENTS 3,266,207 A 8/1966 Birum
3,561,182 A 2/1971 Madl
3,888,055 A 6/1975 Gallo
4,020,610 A 5/1977 Alexander
4,644,711 A 2/1987 Eickhof
4,899,508 A 2/1990 Biebuyck
4,905,334 A 3/1990 Oppenhuizen
5,195,812 A * 3/1993 Eickhof ..... A47B 47/0091 312/257.1
5,477,594 A 12/1995 Lepage
5,802,781 A 9/1998 Eickhof
5,979,124 A 11/1999 Branan
7,108,141 B2 9/2006 Gonzalez-Rivera
7,591,053 B2 9/2009 Bosisio et al.
8,051,623 B2 11/2011 Loyd
(Continued)

FOREIGN PATENT DOCUMENTS

WO 2012033499 A1 3/2012

*Primary Examiner* — Brian D Mattei
(74) *Attorney, Agent, or Firm* — Merchant & Gould, P. C.

(57) ABSTRACT

A columbarium includes a shutter mounting system for mounting shutters over niche. The shutter mounting system includes a flange extending outward from an outer edge of the horizontal panel of each niche, the flange having a channel formed parallel to the outer edge of the base. An upper mounting assembly attaches to the inner face of the shutter, and includes an upper mounting bracket attached to the inner face of the shutter to support an upper engagement element to engage a channel in a flange of an adjacent higher niche. Lower shutter mounting assemblies each have a lower engagement element, and a lower mounting bracket attached to the inner face of the shutter to support the lower engagement element to extend into the channel in the flange of the niche. A second shutter mounting system mounts a shutter over a topmost niche and includes a bracket and plunger.

13 Claims, 20 Drawing Sheets

(56) References Cited

U.S. PATENT DOCUMENTS

| | | | | |
|---|---|---|---|---|
| 8,122,650 | B2 * | 2/2012 | Eickhof | E04H 13/006 52/510 |
| 8,245,457 | B2 | 8/2012 | Eickhof | |
| 8,438,794 | B2 | 5/2013 | Eickhof | |
| 8,782,969 | B2 * | 7/2014 | Eickhof | E04H 13/006 52/510 |
| 10,487,529 | B2 * | 11/2019 | Tollefson | E04H 13/003 |
| 2002/0092247 | A1 * | 7/2002 | Thomas | E04H 13/006 312/109 |
| 2010/0300016 | A1 * | 12/2010 | Eickhof | E04H 13/006 52/587.1 |
| 2012/0167488 | A1 * | 7/2012 | Eickhof | E04H 13/006 52/139 |
| 2013/0199111 | A1 * | 8/2013 | Eickhof | E04H 13/006 52/134 |
| 2016/0356055 | A1 * | 12/2016 | Trousil | E04H 13/006 |

* cited by examiner

SHUTTER MOUNTING SYSTEM

BACKGROUND OF THE INVENTION

Field of the Invention

The present invention relates to an easily adjustable concealed fastening mechanism for attaching stone slabs, wood panels or other shutters to a framework or structure of a columbarium for achieving a substantially planar wall of shutters.

Prior Art

As cost and space issues have led to fewer conventional burials and an increased number of people choosing cremation, different systems have been developed for interment of cremated remains, commonly referred to as cremains, in a dignified and respectful manner. Above ground columbarium systems have become well known and include multiple storage compartments, commonly referred to as niches, which are able to store urns in a dignified and secure manner and to withstand exposure to the elements for the extended periods of time required.

Columbaria typically have decorative shutters acting as covers removably secured to columbarium niches or support structures by a mounting system that is preferably substantially concealed or substantially hidden from view so as not to detract from the appearance of the stone and the reverent ambience of the columbarium. The concealed mounting system must resist corrosion and it must securely hold the shutters in position despite extreme temperature swings and freeze-thaw cycles for decades, if not centuries. Moreover, the mounting system must permit the shutters to be relatively easily removed and replaced even after years or decades of being exposed to the elements.

U.S. Pat. No. 4,644,711 to Eickhof discloses one type of concealed shutter mounting system that addresses all of the foregoing challenges. Variations of the Eickhof '711 concealed shutter mounting system have achieved significant commercial success and are widely used in installations throughout the world.

Further developments in mounting have led to further improvements in shutter mounting hardware. Such a system is disclosed in U.S. Pat. No. 8,782,969 to Eickhof, which shows further enhancements to a shutter locking system. The system in U.S. Pat. No. 8,782,969 provides for easily adjusting the relative position of the shutter to achieve a façade of continuously spaced and aligned shutters. The shutter maybe easily removed by using tools extending through gaps above the shutters from the front of the niche.

Although the system of U.S. Pat. No. 8,782,969 provides superior flexibility, the system uses swivel socket mounts. Although such swivel socket mounts provide great flexibility for positioning the shutter nearer or further from the niche, swivel sockets can be somewhat cumbersome to adjust to attain desired shutter positioning, increasing installation time. While swivel sockets allow the shutter to be adjusted in and out, this movement tends to follow an arc. For some swivel socket installations, the shutters on swivel socket mounts tend to move side to side when trying to adjust it in/out and vice versa. Such movement is undesirable and may take considerable time and/or skill to position the shutters to align correctly.

If swivel socket mounts can be avoided and the adjustment required for such systems is eliminated, positioning the front of the shutters correctly may be substantially faster. It can also be appreciated that improvements in stone cutting technology has achieved shutters that are very consistent in size and thickness. Therefore, with consistent thickness, there is no need for in/out adjustment that was once necessary for shutters that varied in thickness.

It can be seen that a new shutter mounting system is needed that overcomes the issues related to mounting systems prone to arcing. Such a system should be concealed and provide easy actuation through a gap above the shutter and provide for easily and securely opening and closing of the shutter. Such a system should utilize inexpensive hardware elements with minimal parts and be able to retrofit to prior mounting systems. The present invention addresses these problems as well as others associated with concealed shutter mounting systems for a columbarium.

SUMMARY OF THE INVENTION

The present invention is directed to a columbarium and in particular to a columbarium with concealed mounting hardware for uppermost niches that does not raise adjustment screws and avoids forming channels or notches in the cover over the uppermost niches. A columbarium may have a varied shape and size with multiple niches. The niches are covered with removable shutters, such as stone or wood shutters. Each of the niches provides a compartment for storing an urn or a small number of urns in a dignified manner. The columbarium also includes a base, walls and a cover, such as a capstone.

The interior of the columbarium includes a framework with sidewalls, and rear walls forming the sides of the niches. For some installations, a further inner cover may be used. The tops and bottoms of the niches are formed by shelves that mount using brackets. The shelves may be extruded and include a front flange portion for mounting a shutter mounting hardware system. To accommodate and retain mounted bolts (lugs), the front flange portion includes a channel extending parallel to a front edge. It can be appreciated that the columbarium is constructed of materials that have an extended life and are able to withstand harsh conditions in exposed environments.

The shutters are mounted to the columbarium by a concealed shutter mounting system. The shutter mounting system includes lower shutter mounting assemblies, upper shutter mounting assemblies, and uppermost shutter mounting assemblies for the very top tier of shutters below the cover. In some embodiments, the concealed shutter mounting system for each shutter includes one upper mounting assembly or one uppermost shutter mounting assembly laterally positioned substantially at the upper middle of the rear face of each shutter and a pair of lower shutter mounting assemblies near the outer edges of each shutter.

In one embodiment, the concealed shutter mounting system includes at least one lower shutter mounting assembly, and preferably two for each shutter. A rear face of the shutter includes an L-shaped bracket with a vertical leg extending along the rear face of the shutter and bolted or otherwise mounted to the shutter. A projecting leg includes a threaded orifice, for cooperatively engaging and supporting a complementary vertically extending threaded stud. The stud includes a chamfered head that rests in the channel of the front flange. With this configuration, the shutters may be pivoted about the heads of the studs engaged with the channel for mounting and removal of one of the shutters.

In one embodiment, the upper shutter mounting assemblies and the uppermost shutter mounting assembly includes a support member. The support member includes a rearward extending flange portion having a slot formed therein for receiving a lug. The rearward extending portion may include upper and/or lower gripping surfaces to help prevent elements slipping relative to one another. In one embodiment, the lug has a head fitting into the channel of the front rail. For the uppermost shutter mounting assembly, the lug extends upward through an orifice in the shelf front portion and through the slot. In this manner, the support member is mounted below the shelf front portion in one embodiment. A vertical portion of the support member extends upward from a forward end of the rearward extending portion. A screw support portion extends forward from the vertical portion of the support member. The screw support portion includes an orifice. The support member also includes a pair of parallel downward extending planar legs extending downward from the screw support portion.

The uppermost shutter mounting assembly also includes a threaded plunger. A vertically extending uppermost locking screw is configured to threadably engage the threaded plunger. The uppermost locking screw includes a center collar portion having a first portion having a first diameter and a second portion having a second diameter greater than the first diameter. The collar portion is configured so the first portion may extend into the orifice, while the second portion is wider than the orifice. A hex nut threadably mounts to an upper end of the uppermost locking screw. Therefore, the uppermost locking screw extends through the orifice, so the screw support portion is retained between the hex nut and the second wider portion of the uppermost locking screw. The hex nut is fixed to the uppermost locking screw by welding, soldering, brazing, adhesive or other conventional attachment method.

The plunger includes a lower angled surface. The plunger is configured to extend below an upper end of an angled engagement member on the rear face of the shutter when engaged. The angled surface helps to guide the plunger into the space behind a curved inner surface of the angled engagement surface. The plunger includes planar front and rear faces. The plunger is sized to fit between the legs, but is sufficiently wide that edges of the planar faces engage inner faces of the legs to block the plunger from rotating relative to the legs.

The concealed mounting hardware is accessed from outside the columbarium with a flat wrench inserted through narrow horizontal space between adjacent shutters. When the uppermost shutter mounting assembly is released, the shutter may be pivoted outward about the lower shutter mounting assemblies. The shutter may then simply be lifted off and removed. To mount a shutter, the process is reversed.

The uppermost shutter mounting assembly provides for engagement of the hex nut by a wrench and turning clockwise or counterclockwise to rotate the uppermost locking screw. The uppermost locking screw does not rise or fall as it is held vertically by the collar portion and hex nut positioned vertically above and below the screw support portion. Therefore, no notches or channels need be formed in the underside of the cover to provide clearance, and manufacturing is simplified. Although the uppermost locking screw does not rise and fall, rotation of the uppermost locking screw causes it to rotate relative to the threaded plunger. As the plunger is blocked from rotation relative to the legs, the plunger is travels along the uppermost locking screw when the uppermost locking screw rotates and is therefore raised or lowered. The plunger is raised and retracted toward the screw support portion for removal or before mounting. To lock the shutter in place, the uppermost locking screw is rotated so that the plunger travels lower along the uppermost locking screw to an engagement position. In either configuration, the screw and hex nut remain at the same elevation.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

DETAILED DESCRIPTION OF THE PREFERRED EMBODIMENT

Figure 1:
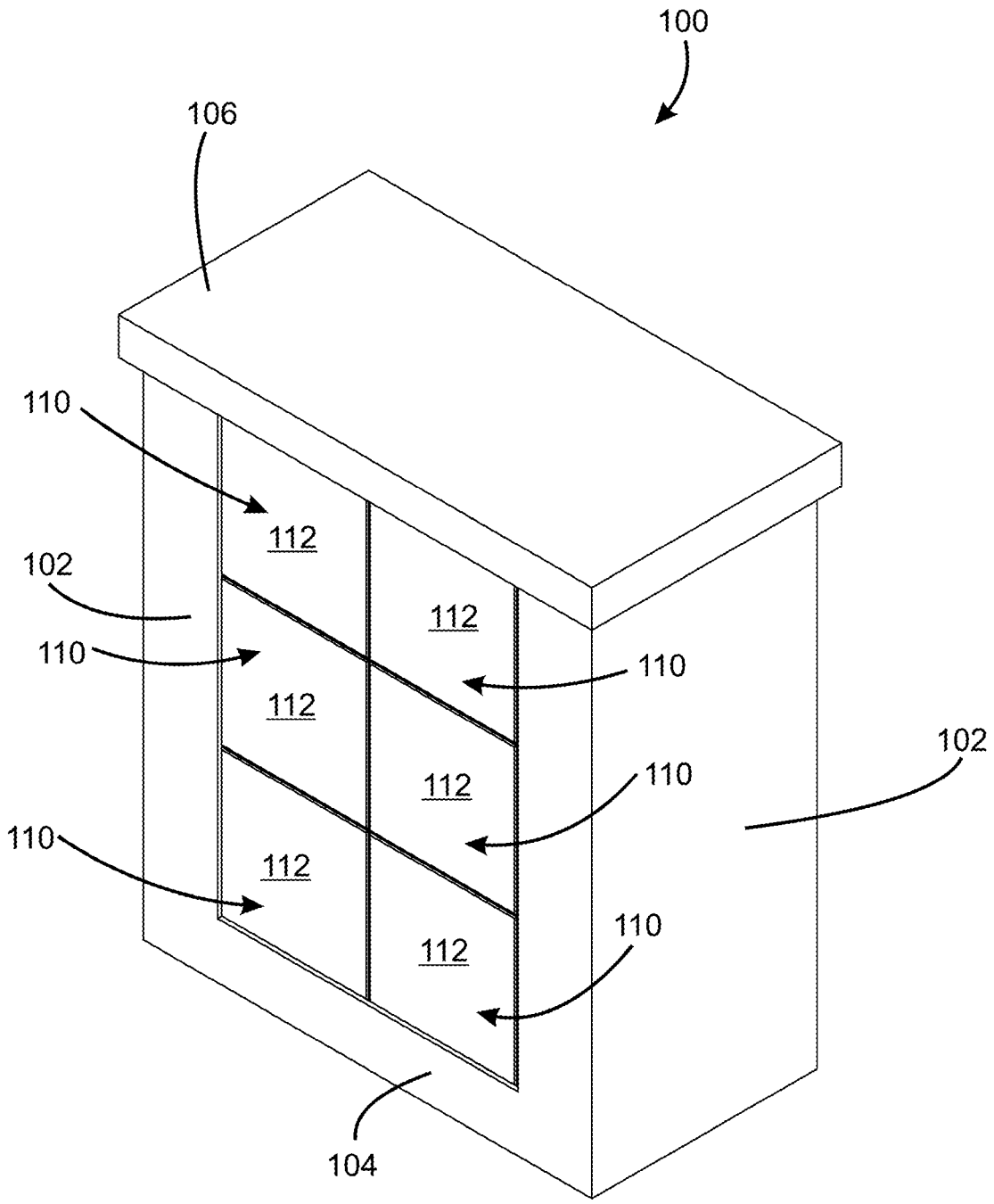
FIG. 1 is a perspective view of a columbarium according to the principles of the present invention.
Figure 2:
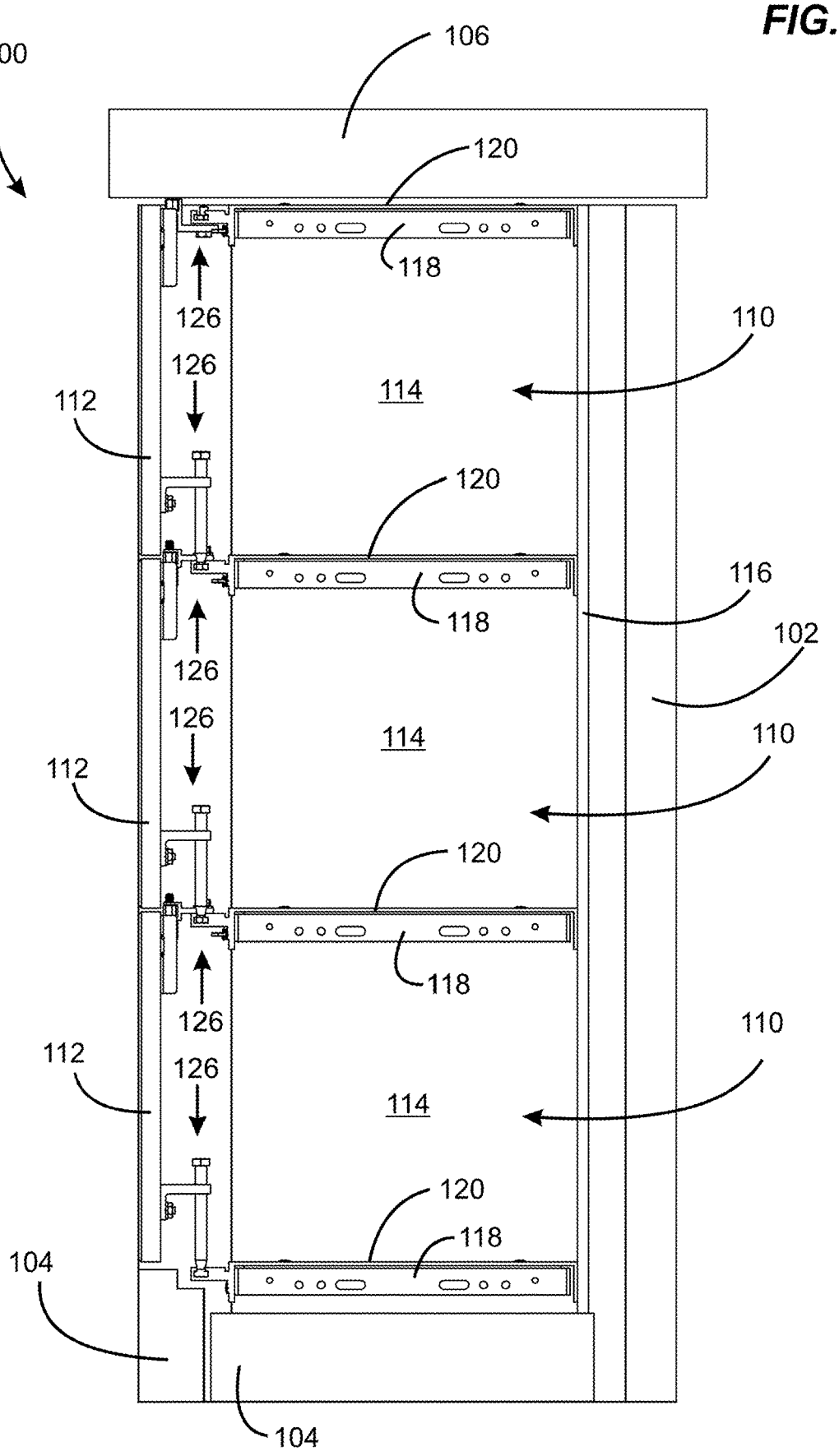
FIG. 2 is a side sectional view of a first embodiment of the columbarium shown in FIG. 1.
Figure 3:
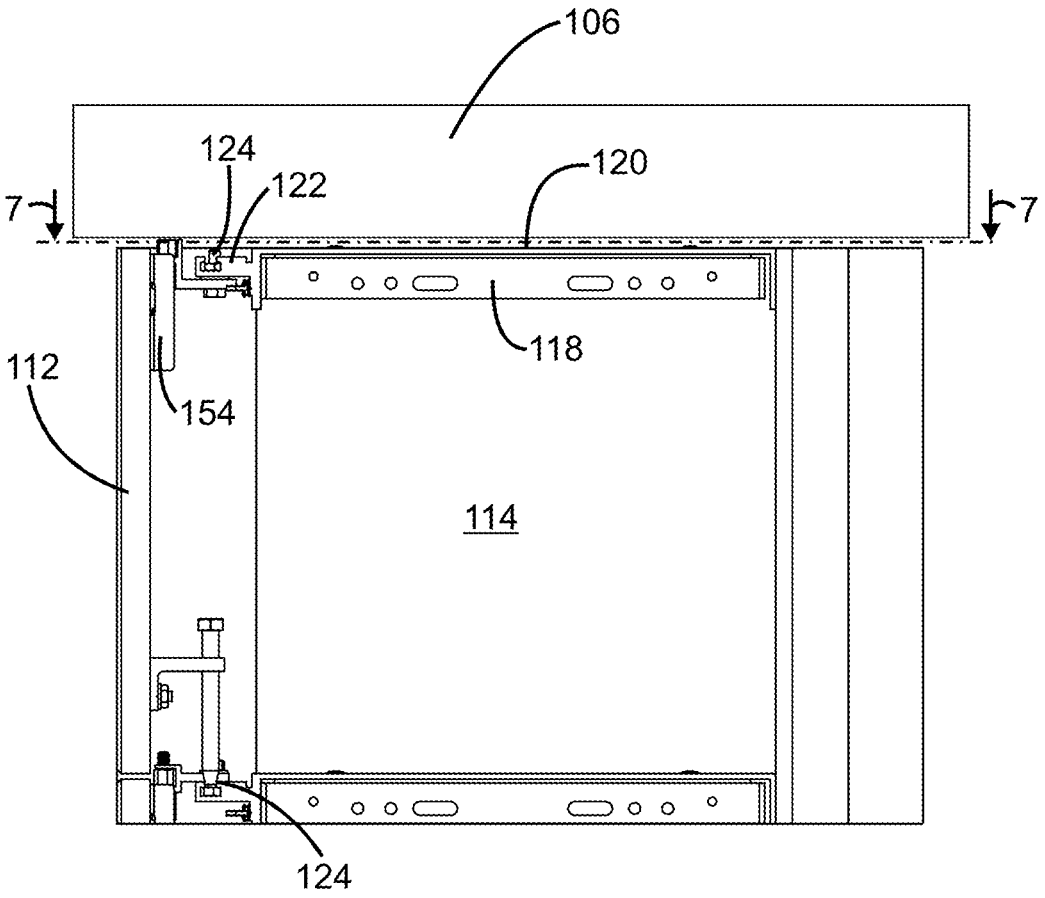
FIG. 3 is a side sectional view of a top niche and shutter mounting system for the columbarium shown in FIG. 1.
Figure 4:
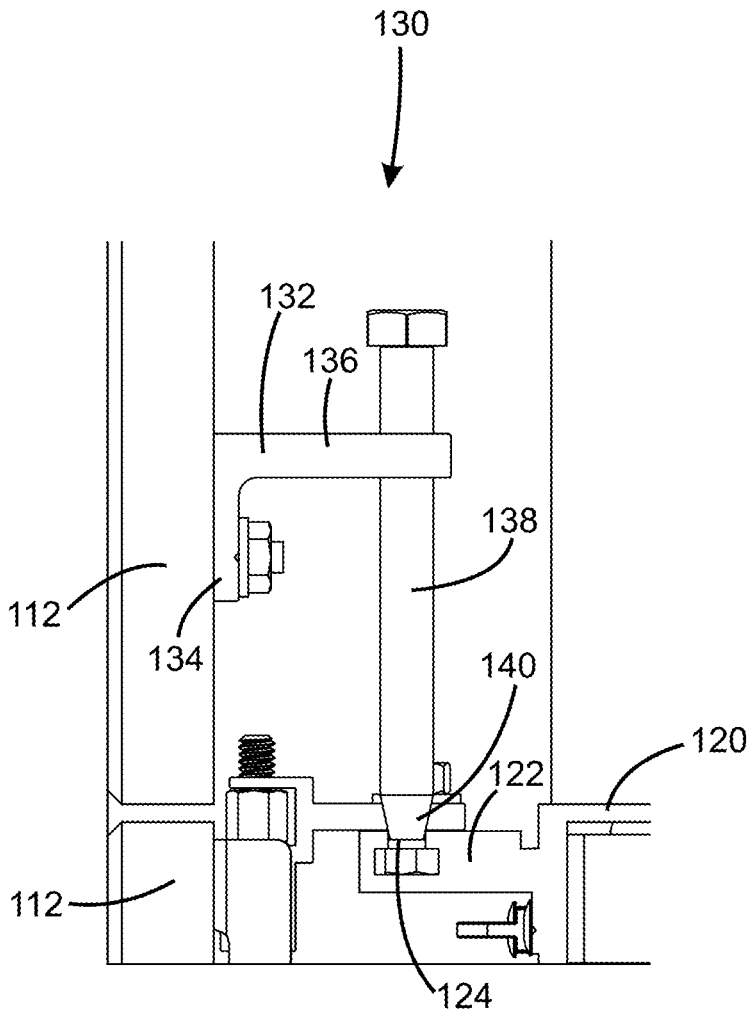
FIG. 4 is a side sectional detail view of the top niche and shutter mounting system for the columbarium shown in FIG. 3.

Referring now to the drawings and in particular to FIG. 1, there is shown a first embodiment of a columbarium, generally designated 100. In the embodiment shown, the columbarium 100 is substantially rectangular with a plurality of niches 110 along one side of the columbarium 100. The niches 110 are covered by removable shutters 112. In the embodiment shown, the columbarium 100 includes six (6) individual niches 110, although the size of the columbarium and the number of sides can be varied to change the total number of niches. Although a rectangular configuration is shown, it can also be appreciated that other shapes are possible such as columbaria with 6, 8 or more sides and having a substantially round configuration with niches disposed about a periphery of the columbarium. As shown more clearly in FIGS. 2-4, each of the niches 110 provides a compartment for storing an urn or a small number of urns in a dignified manner. The columbarium 100 also includes a base 104, walls 102 and a cover, such as a capstone 106.

Referring to FIGS. 2-3 and 5-6, the interior of the columbarium 100 includes a framework with sidewalls 114 and a rear wall 116 forming the sides of the niches 110. For some installations, a further inner cover may be used. The tops and bottoms of the niches 110 are formed by shelves 120 that mount using brackets 118. The shelves 120 may be extruded and include a front flange portion, or front rail, 122 for mounting a shutter mounting hardware system 126. To accommodate a threaded studs (lugs), the front flange portion 122 includes a laterally extending channel 124 receiving a lower end of the stud. It can be appreciated that the columbarium 100 is constructed of materials that have a long life and are able to withstand harsh conditions in exposed environments.

Figure 8:
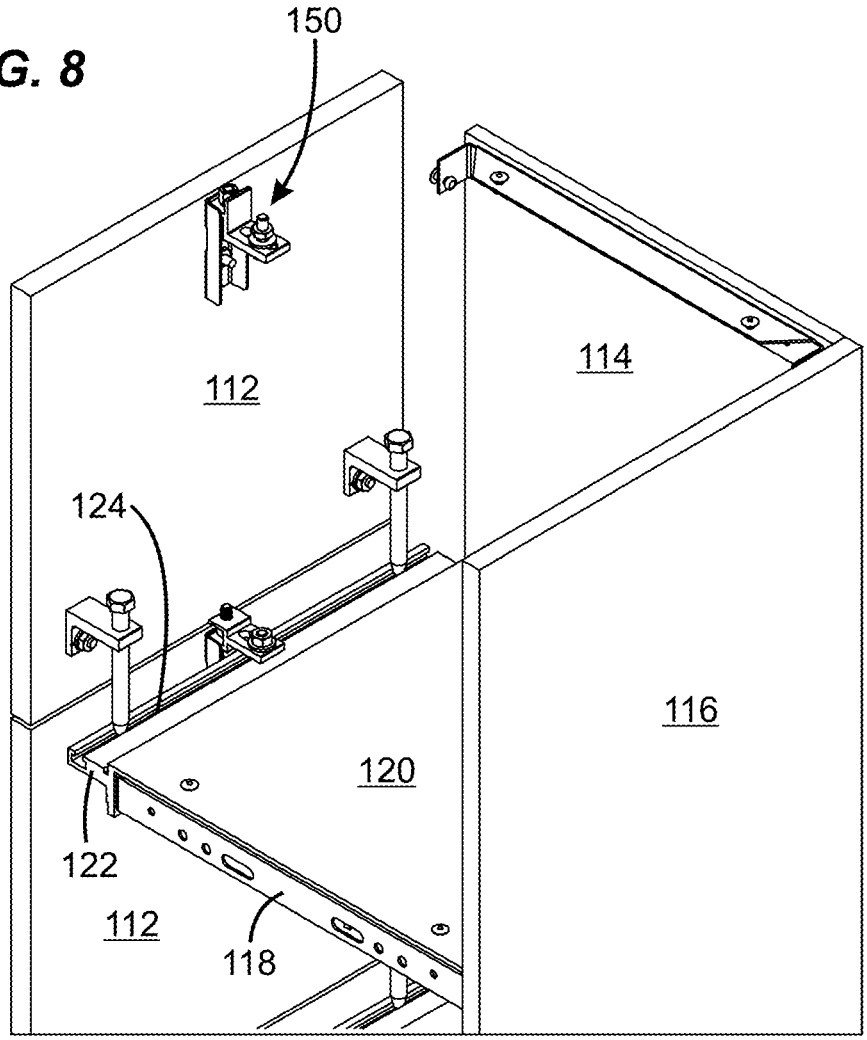
FIG. 8 is a perspective view of the inner side of a shutter and the lock hardware for the niche shown in FIG. 5.
Figure 12:
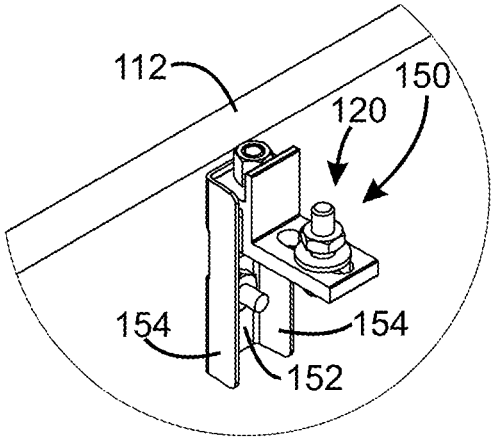
FIG. 12 is a detail perspective view of the inner side of a shutter and the lock hardware shown in FIG. 8.

The shutters 112 are mounted by a concealed shutter mounting system 126. The shutter mounting system 126 includes lower shutter mounting assemblies 130 and upper shutter mounting assemblies 150, such as shown in FIGS. 8 and 12. The concealed shutter mounting system for each shutter includes one upper shutter mounting assembly 150 laterally positioned at the middle of each shutter 112 and a pair of lower shutter mounting assemblies 130 near the outer edges of each shutter 112. Many elements of the shutter mounting system 126 are preferably fabricated from suitably rigid, weather resistant and dimensionally stable, extrudable or pultrudable material.

Figure 5:
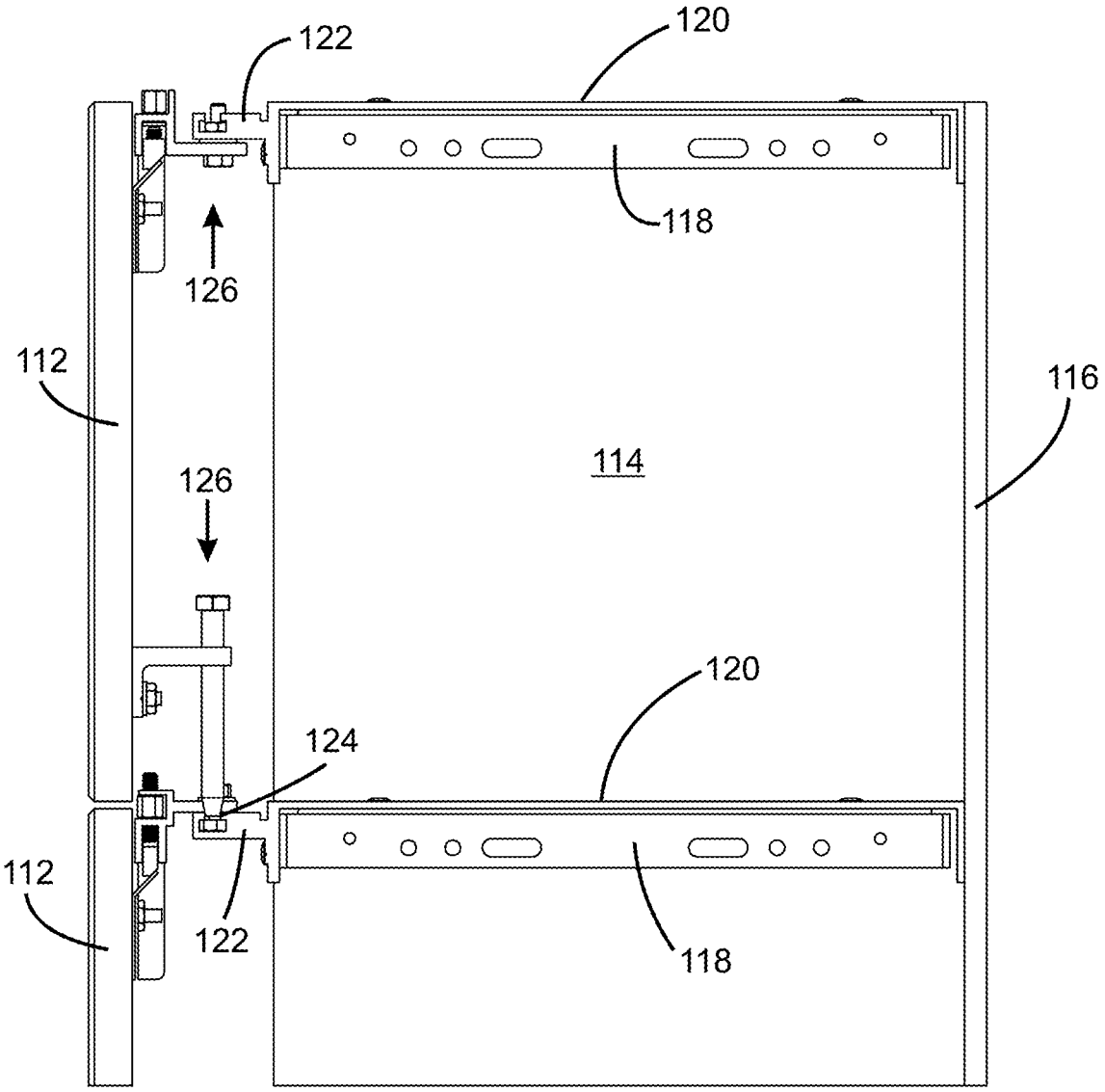
FIG. 5 is a side sectional view of a niche and shutter mounting system for the columbarium shown in FIG. 1.
Figure 6:
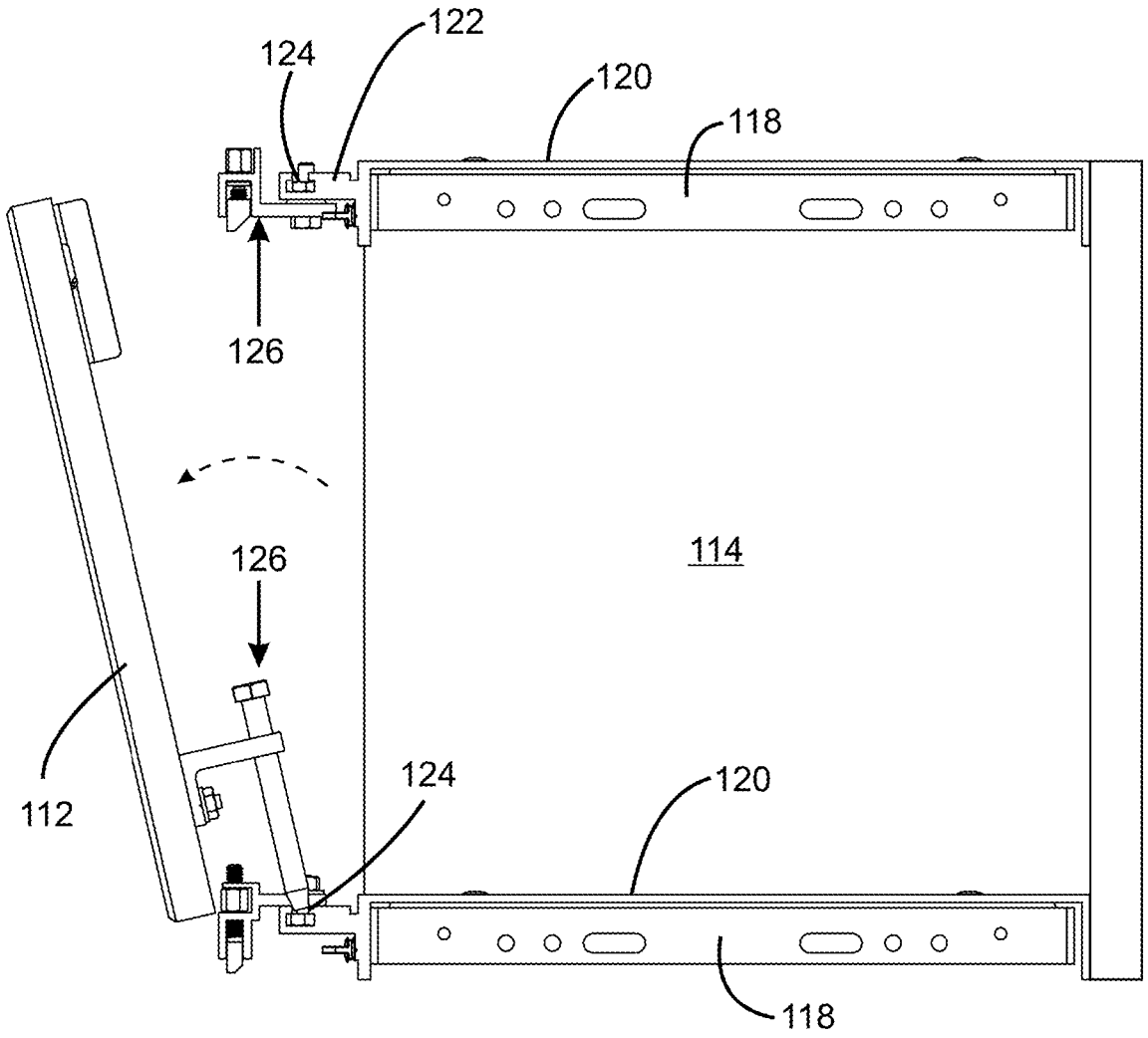
FIG. 6 is a side sectional view of a niche and shutter mounting system shown in FIG. 5 with the top mount disengaged and the shutter tilted outward.
Figure 7:
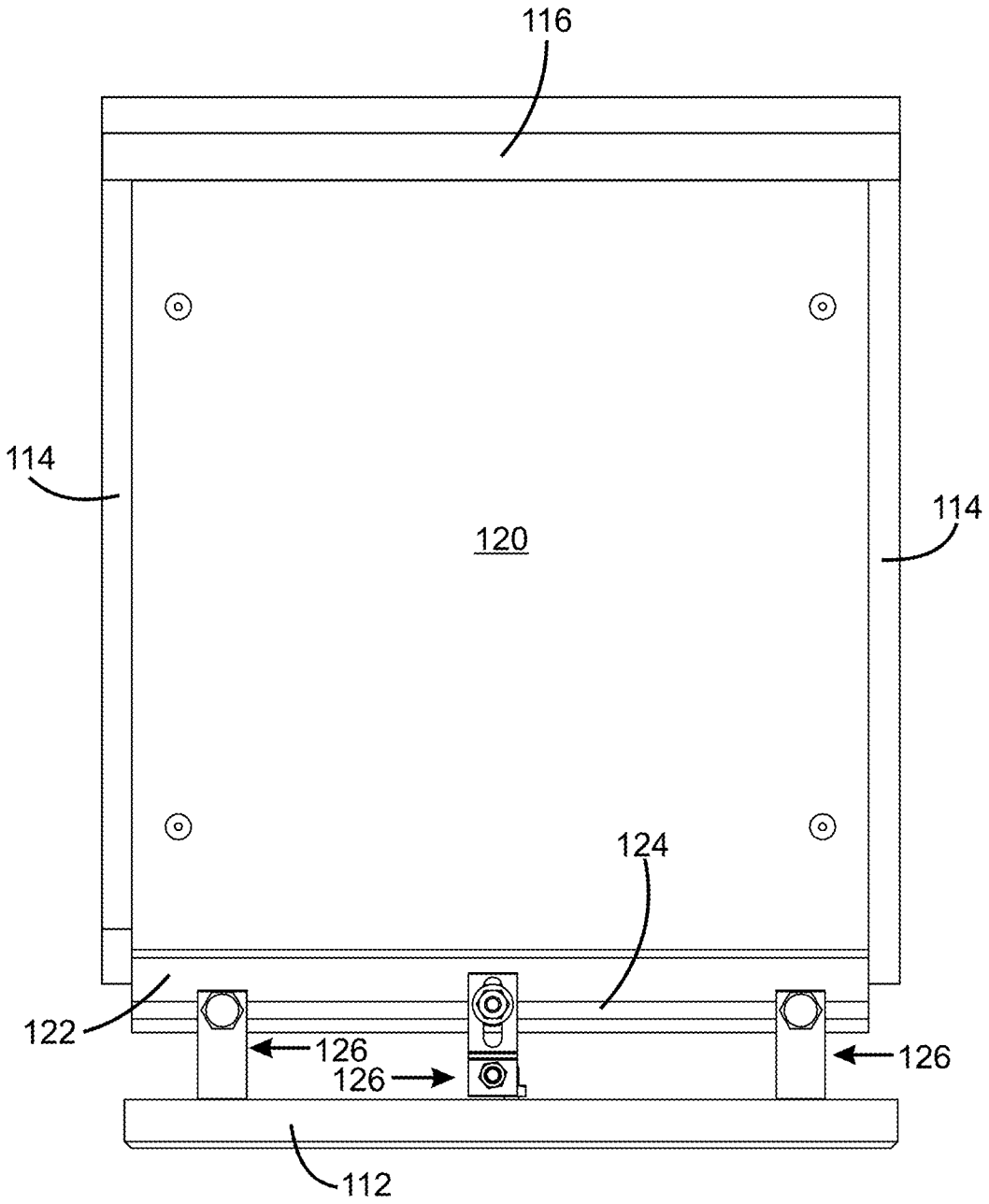
FIG. 7 is a top sectional view of the shutter and the lock hardware taken along line 7-7 of FIG. 3.

Referring to FIGS. 3-10, the concealed shutter mounting system 126 includes at least one lower shutter mounting assembly 130, and preferably two for each shutter 112. A rear face of the shutter 112 includes an L-shaped bracket 132 with a vertical leg 134 extending along the rear face of the shutter 112 and bolted or otherwise mounted to the shutter 112. A projecting leg 136 includes a threaded orifice, for cooperatively engaging and supporting a complementary threaded stud 138. The stud 138 includes a chamfered head 140 that rests in the channel 124. As shown in FIG. 6, the shutters 112 may be pivoted about the chamfered heads 140 engaged with the channel 124 for mounting and removal of one of the shutters 112.

The concealed shutter mounting system 126 also includes an upper shutter mounting assembly, or lock, 150 for each shutter 112. The upper lock 150 includes an upper shutter mounting bracket 152 secured to the back side of the shutter 112. The upper shutter mounting bracket 152 is attached to the inner face of the shutter by a bolt or other suitable attachment. An angled engagement portion 156 extends upward and inward and is configured to engage a complementary element of an assembly mounting to the front flange portion 122 of the niche 110. Wall portions 154 at the sides of the shutter mounting bracket 152 extend inward toward the niche 110. The side wall portions 154 form a retainer so that the support member 180, shown in FIG. 13, of complementary mounting assembly 170 is confined between the side walls 154 to prevent the shutter 112 from sliding laterally when the complementary mounting assemblies 170 are coupled to the upper shutter mounting bracket 152. It can be appreciated that in the embodiment shown in FIGS. 2-12, the same upper shutter mounting assemblies 150 may be used with all niches 110 and shutters 112, including a topmost shutter 112 under a cover 106.

Figure 11:
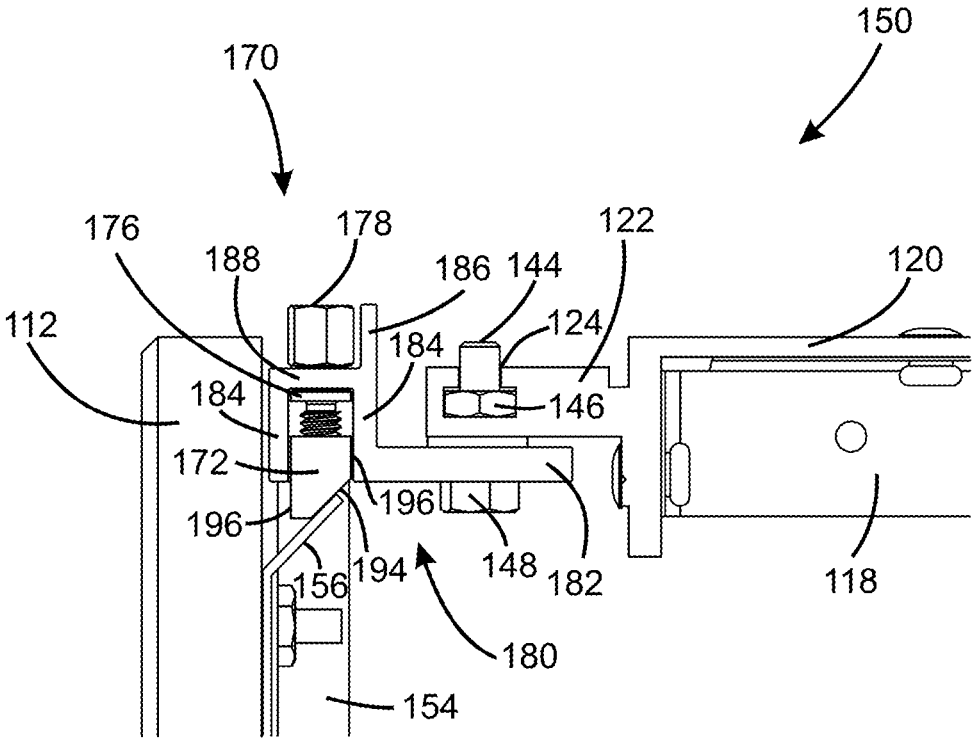
FIG. 11 is a side detail view of the top mounting hardware for the niche shown in FIG. 4.
Figure 13:
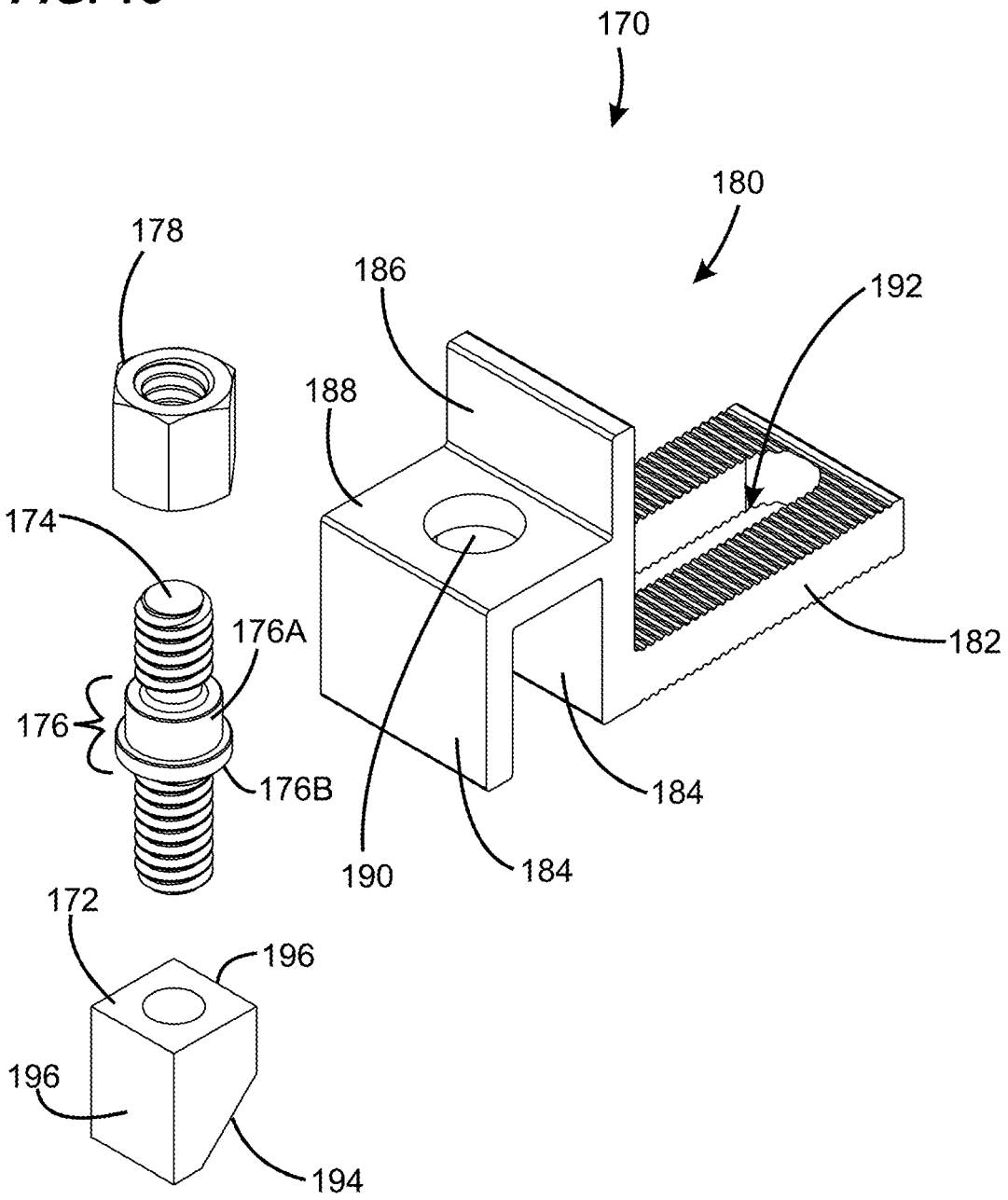
FIG. 13 is an exploded perspective view of the lock elements for the top shutter mounting system shown in FIG. 11.

Referring to FIGS. 11 and 13, the upper complementary shutter mounting assembly 170 includes a support member 180. The support member 180 includes a rearward extending portion 182 having a horizontal slot 192 formed therein for receiving a lug 148, as shown in FIGS. 3-6. The rearward extending portion may include upper and/or gripping surfaces to help prevent elements slipping relative to one another. It can be appreciated that the lug 148 has a complementary hex nut 146 fitting into the channel 124 of the front flange portion 122. A shaft 144 of the lug 148 extends upward through the slot 192 and through an orifice or slot in the channel 124 of the front flange portion 122. The channel 124 prevents the hex nut 146 from rotating so the lug 148 is easily mounted. In this manner, the support member 180 is mounted below the front flange portion 122. A vertical portion 186 extends upward from a forward end of the rearward extending portion 182. A screw support portion 188 extends forward from the vertical portion. The screw support portion 188 includes an orifice 190. The support member 180 also includes a pair of parallel downward extending planar legs 184 extending downward from the screw support portion.

The upper complementary shutter mounting assembly 170 also includes a threaded plunger 172. An upper locking screw 174 includes is configured to threadably engage the threaded plunger 172. The upper locking screw 174 includes a center collar portion 176 having a first portion 176A having a first diameter and a second portion 176B having a second diameter greater than the first diameter. The center collar portion 176 is configured so the first portion 176A may extend into the orifice 190, while the second portion 176B is wider than the orifice 190. A hex nut 178 threadably mounts to an upper end of the upper locking screw 174. Therefore, the upper locking screw 174 extends through the orifice 190 so the screw support portion 188 is retained between the hex nut 178 and the second wider portion 176B of the upper locking screw 174. The hex nut 178 is fixed to the upper locking screw 174 by welding, soldering, brazing, adhesive or other conventional attachment methods.

The plunger 172 includes a lower angled surface 194. The plunger 172 is configured to extend below an upper end of the angled engagement portion 156 when engaged, as shown in FIGS. 5 and 11. The angled surface 194 helps to guide the plunger 172 into the space behind the inner surface of the angled engagement portion 156. The plunger 172 includes planar front and rear faces 196. The plunger 172 is sized to fit between the legs 184, but is sufficiently wide that edges of the planar faces engage inner faces of the legs to block the plunger 172 from rotating relative to the legs 184.

Figure 9:
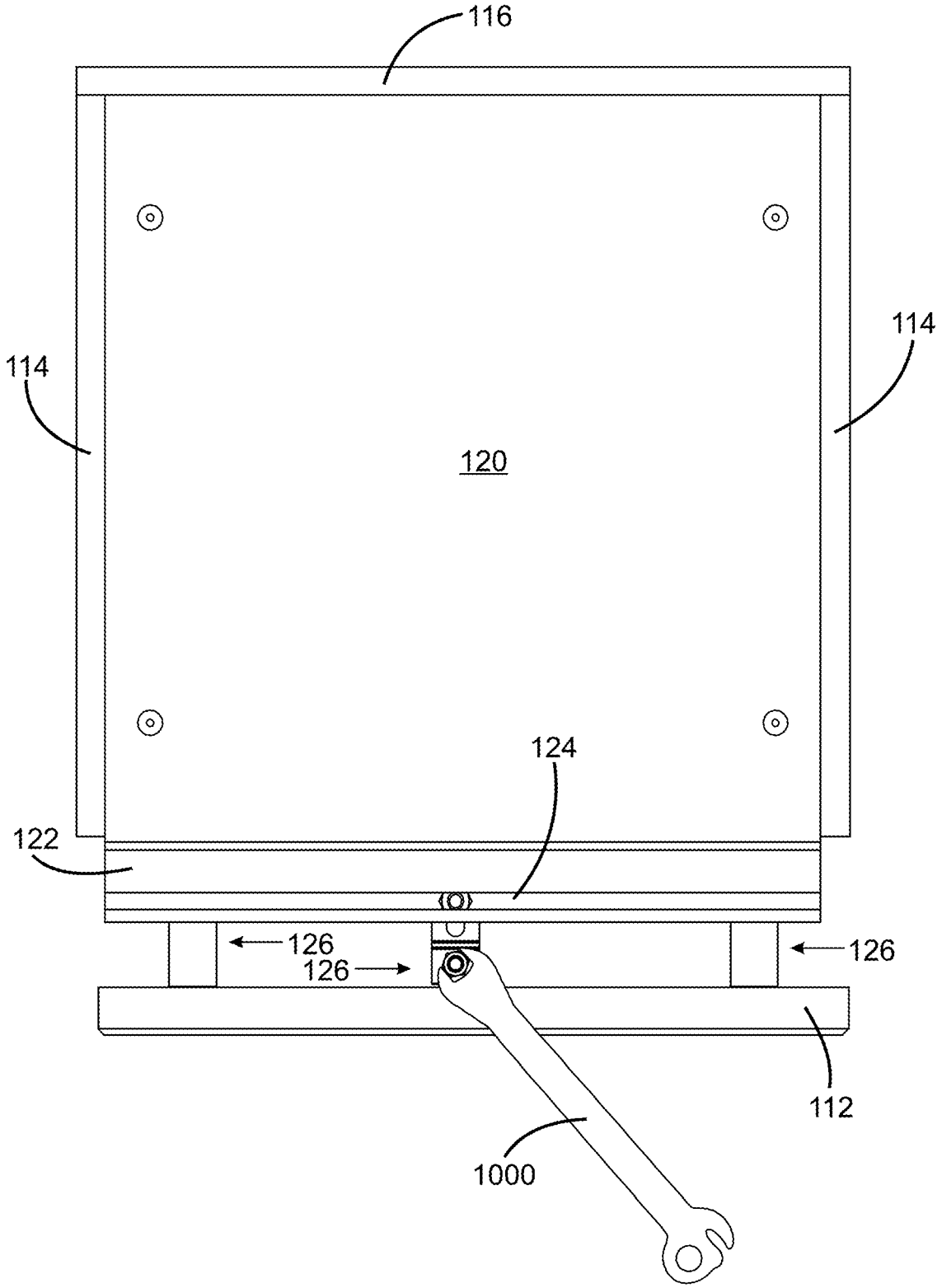
FIG. 9 is a top sectional view of the shutter and the lock hardware shown in FIG. 7 and a wrench engaging the nut.
Figure 10:
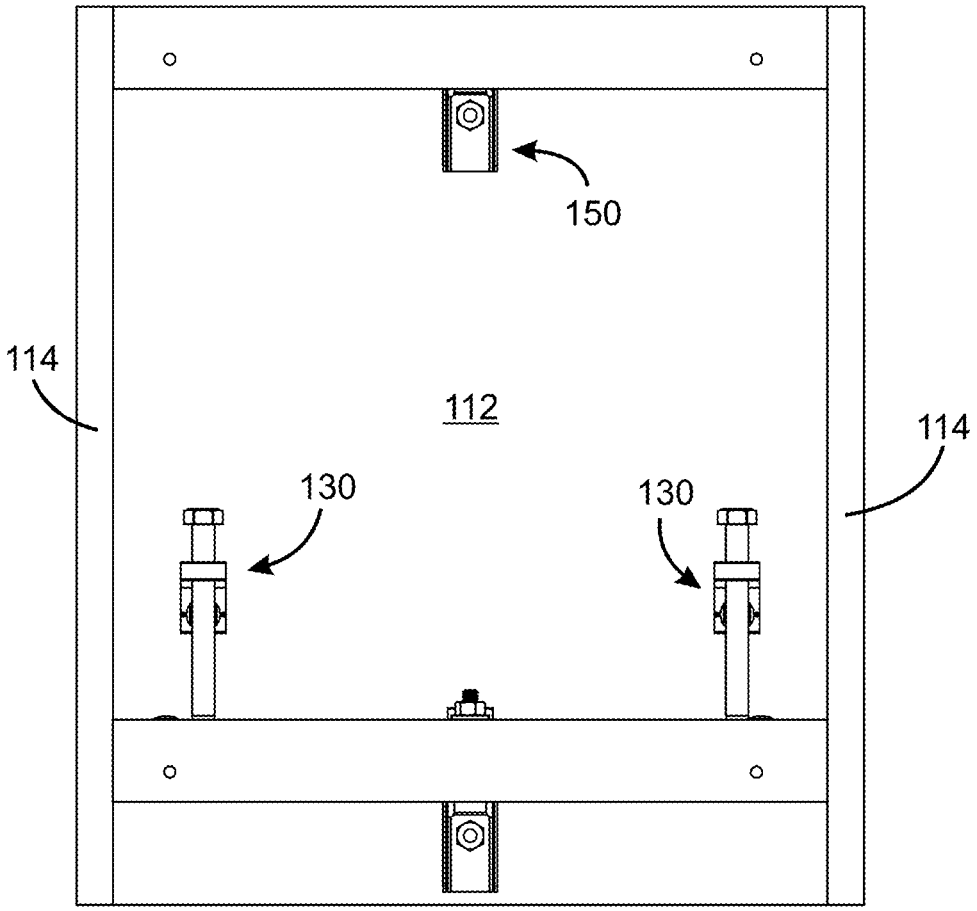
FIG. 10 is an elevational view of an inner side of a shutter and mounting hardware of the niche shown in FIG. 4.
Figure 19:
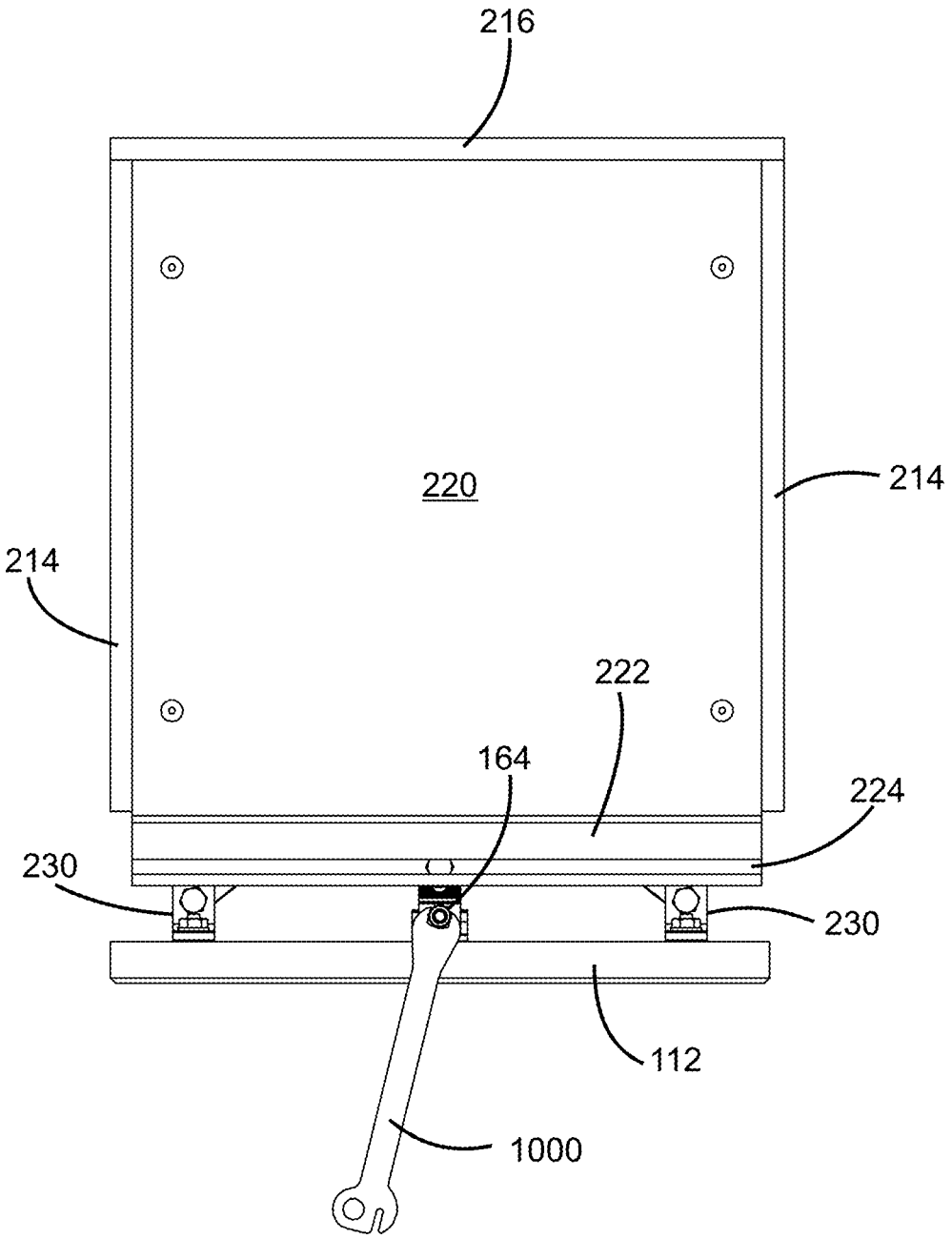
FIG. 19 is a top sectional view of the shutter and the lock hardware shown in FIG. 14 and a wrench engaging the nut.
Figure 20:
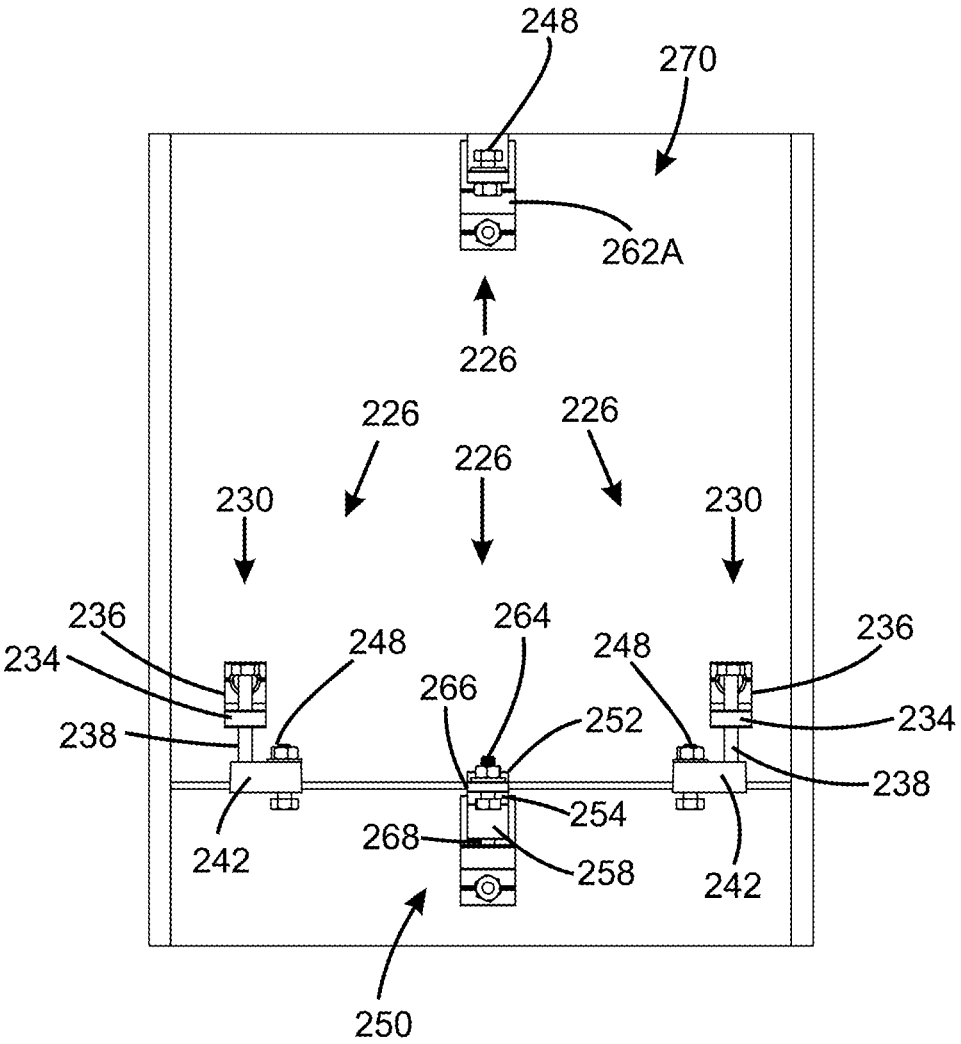
FIG. 20 is an elevational view of the inner side of a shutter and the lock hardware shown in FIG. 14.

The upper concealed mounting hardware 150 and 170 are accessed from outside the columbarium 100 with a flat wrench 1000 inserted through narrow horizontal space between adjacent shutters 112, such as shown in FIG. 9, or between the uppermost shutter 112 and the cover 106. When the upper shutter mounting assembly 150 is released, the shutter 112 may be pivoted outward about the lower shutter mounting assemblies 130, such as shown in FIG. 6. The shutter 112 may then simply be lifted off. To mount a shutter 112, the process is reversed. The vertical position of the shutter 112 may be varied by rotating the threaded studs 138 to raise and lower them. Referring to FIG. 19, the locking screw 164 and the plunger 172 are raised or lowered by engaging the associated hex nut 178 with the wrench 1000 and turning in the appropriate direction to raise or lower. The distance from the shutter 112 to the niche 110 can be varied by loosening the lug 148 and moving it along the slot 192 to move the complementary upper shutter mounting assembly 150 in or out.

It is appreciated that the uppermost shutter mounting assembly 170 provides for engagement of the hex nut 178 by the wrench 1000 and turning clockwise or counterclockwise to rotate the upper locking screw 174. The uppermost locking screw does not rise or fall as it is held vertically by the collar portion 176B and hex nut 178 positioned above and below the screw support portion 188. It is appreciated that no notches or channels need be formed in the underside of the cover 106 and manufacture is simplified. Although the upper locking screw 174 does not rise and fall, rotation of the uppermost locking screw causes it to rotate relative to the threaded plunger 172. As the plunger 172 is blocked from rotation relative to the legs 184, the plunger 172 travels axially along the upper locking screw 174 when the upper locking screw 174 rotates, thereby causing the plunger 172 to rise or fall. The plunger 172 is raised and retracted toward the screw support portion 188 for removal or before mounting, as shown in FIG. 6. To lock the shutter 112 in place, the upper locking screw 174 is rotated so that the plunger 172 travels lower along the uppermost locking screw 172 to an engagement position with the angled engagement portion 156, as shown in FIGS. 5 and 11. In either configuration, the screw 174 and hex nut 178 remain at the same elevation.

Referring to FIGS. 14-20, a second embodiment of the columbarium 100 includes exterior features as shown in FIG. 1. Referring to FIGS. 14-18, an interior of the columbarium 100 includes a framework with sidewalls 214 and a rear wall 216 forming the sides of the niches 110. For some installations, a further inner cover may be used. The tops and bottoms of the niches 110 are formed by shelves 220 that mount using brackets 218. The shelves 220 may be extruded and include a front flange portion 222 for mounting a shutter mounting hardware system 226. To accommodate and retain mounted bolts (lugs) 248, the front flange portion includes a channel 224 receiving a head of the lug 248. It can be appreciated that the columbarium 100 is constructed of materials that have a long life and are able to withstand harsh conditions in exposed environments.

The shutters 112 are mounted by a concealed shutter mounting system 226. In the embodiment of FIGS. 14-20, the shutter mounting system 226 includes lower shutter mounting assemblies 230, upper shutter mounting assemblies 250, and uppermost shutter mounting assemblies 270 for the top tier of shutters 112 below the cover 106. In the embodiment shown in FIG. 20, the concealed shutter mounting system 226 for each shutter includes one upper mounting assembly 250 or one uppermost shutter mounting assembly 270 laterally positioned at the middle of each shutter 112 and a pair of lower shutter mounting assemblies 230 near the outer edges of each shutter 112. The lower shutter mounting assembly 230 and the upper shutter mounting assembly 250 are similar to those of U.S. Pat. No. 8,782,969 to Eickhof, incorporated herein by reference. The elements of the shutter mounting system 226 are preferably fabricated from suitably rigid, weather resistant and dimensionally stable, extrudable or pultrudable material.

The concealed shutter mounting system 226 includes at least one lower shutter mounting assembly 230, and preferably two for each shutter 112. A rear face of the shutter 112 includes an L-shaped bracket 232 with a vertical leg 236 extending along the rear face of the shutter 112 and bolted or otherwise mounted to the shutter 112. A projecting leg 234 includes a threaded orifice, for cooperatively receiving and supporting a threaded stud 238. Each lower shutter mounting assembly 230 includes a hanger support 242 mounted to swivel at two pivot axes with an elongated body having an aperture near one end and a socket or indentation at an opposite end. The swivel hanger support 242 is slidably positioned along the top channel 224 of the front rail 222 by a threaded lug 248 having a head received within the top channel 224 of the front rail 222. The shaft of the lug 248 extends through the top channel 224 and into the aperture of the hanger support 242 and is secured by a nut. By loosening and tightening the nut, the hanger support 242 can pivot or swivel about the lug 248 and can be slidably, adjustably, fixably positioned anywhere along the length of the top channel 224 in order to align the socket 242 to receive the downwardly extending threaded stud 238. Furthermore, turning the threaded stud 238 clockwise or counterclockwise causes the shutter 112 to raise or lower, respectively, relative to the hanger support 242 and front rail 222 to achieve vertical adjustment of the shutter 112. Similarly, by loosening and tightening the nut on the lug 248, the hanger support 242 can be pivoted inwardly or outwardly relative to the front rail 222 to provide in-and-out adjustment at the bottom of the shutter 112. It can be appreciated that the lower end of the stud 238 rests in the socket of the hanger support 242 and to remove the shutter, the shutter 112 is pivoted outward and the shutter 112 lifted to remove the stud 238 from the hanger support 242.

The concealed shutter mounting system 226 also includes an upper mounting assembly, or lock 250. The upper lock 250 includes a rearwardly projecting flange 252A having an elongated slot 254. Similar to the swiveling hanger supports 242, the upper shutter mounting assembly 250 is slidably positioned along the front rail 222 by a threaded lug 248 having a head received within the top channel 224 of the front rail 222. The shaft of the lug 248 extends through the top channel 224 and into the elongated slot 254 of the rearwardly projecting flange 252. By loosening and tightening the nut threaded over the shaft of the lug 248, the lug 248 may be moved along the slot 254 and the upper shutter mounting assembly 250 can be positioned inwardly or outwardly relative to the front rail 222 to provide in-and-out adjustment at the top of the shutter 112. Furthermore, by loosening and tightening the nut on the lug 248, the upper lock can be slidably, adjustably, fixably positioned at the desired location along the channel 224.

In one embodiment, the upper shutter mounting assembly 250 includes a forwardly extending upper channel 256 formed between forward projecting portions 252C, and a downwardly extending channel 258 formed between downward projecting legs 252B. Orifices extend through the forwardly projecting portions 252C. A locking screw or bolt 264 passes through both orifices. The locking screw 264 includes a threaded upper shaft portion 266 and a rectangular lower shaft portion 268. The threaded upper shaft portion 266 is threadably received by a nut disposed within the forwardly extending channel 256. The nut is larger than the diameter of the orifices such that the locking screw 264 is vertically supported within the forwardly extending channel 256 by the nut. The width of the rectangular lower shaft 268 of the locking screw is slightly less than the width between the legs 252B of the downwardly extending channel 258 such that the rectangular lower shaft 268 prevents the locking screw 264 from rotating within the channel 258.

Figure 16:
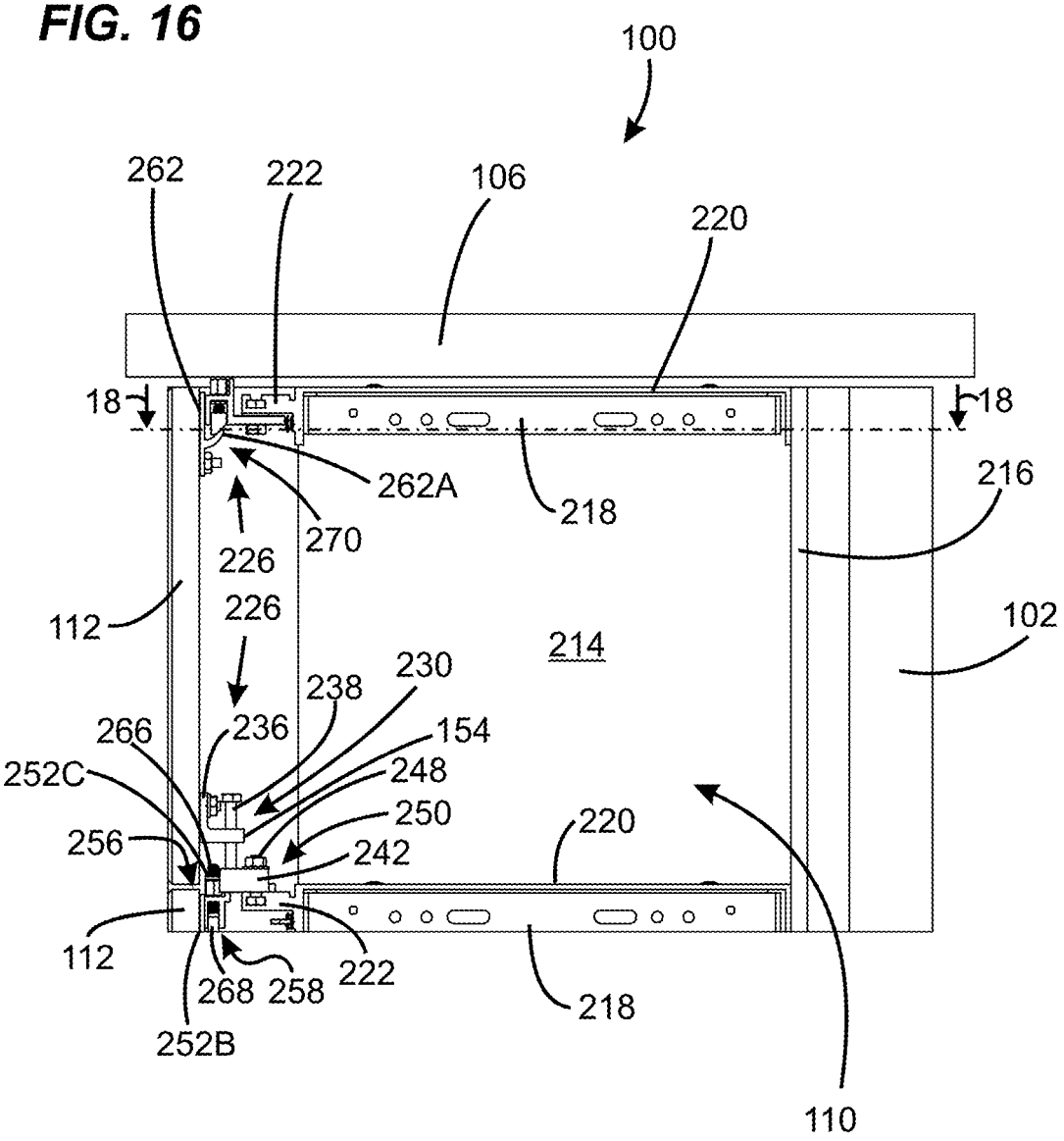
FIG. 16 is a side sectional detail view of a top niche and shutter mounting system for the columbarium shown in FIG. 14.
Figure 17:
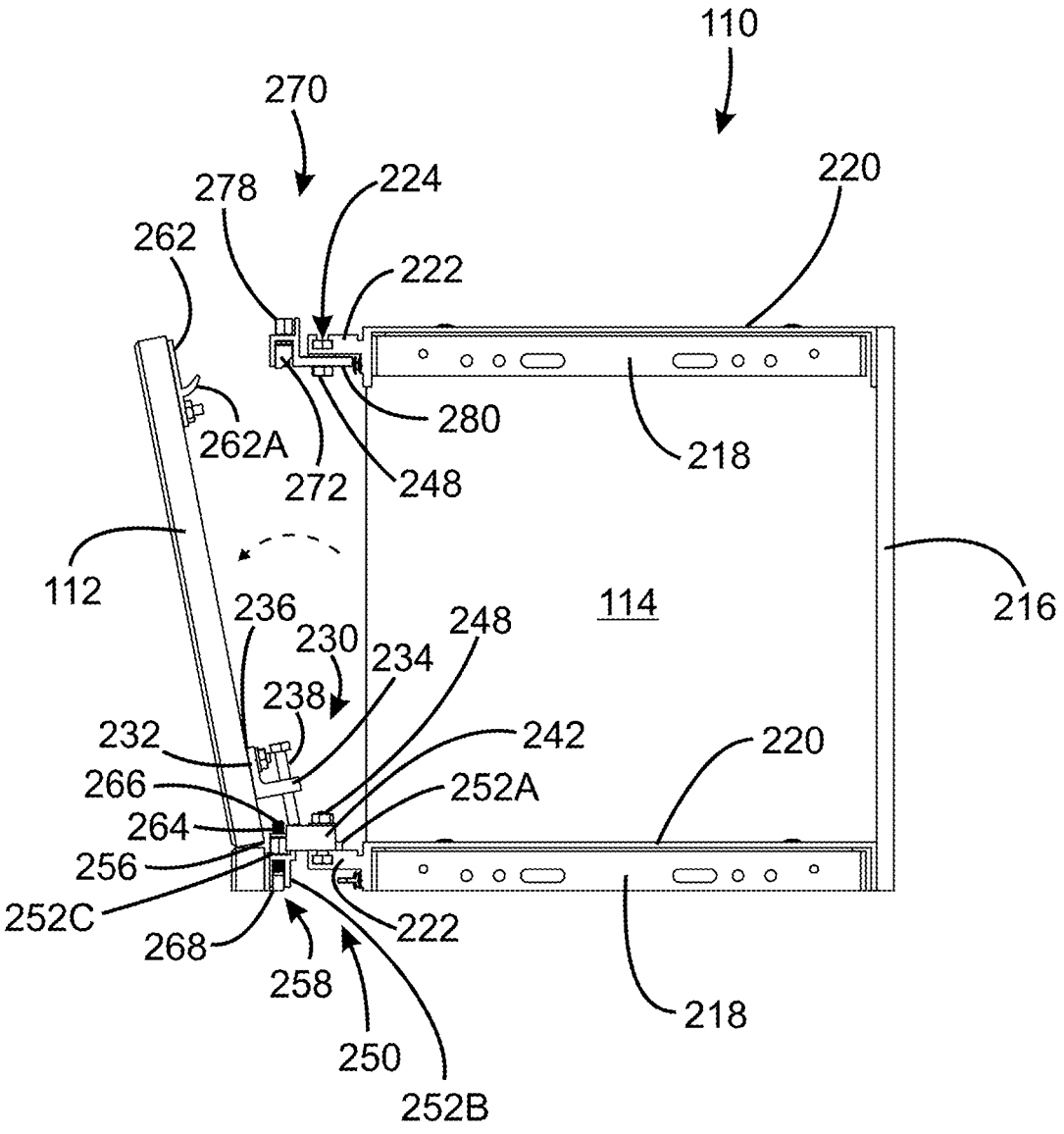
FIG. 17 is a side detail view of the top niche and the shutter mounting system shown in FIG. 14 with the lock hardware disengaged and the shutter tilted away from a face of the columbarium.

Referring to FIGS. 16-17, the concealed shutter mounting system 226 includes an upper clip 262 secured to the back side of the shutter 112. The upper clip 262 includes an upwardly curving hook 262A that receives and is engaged by the upper shutter mounting assembly 250 or the uppermost shutter mounting assembly 270, describe hereinbelow. The rectangular lower shaft portion 268 extends into the hook 262A to mount the shutter 112 to the columbarium 100. By rotating the locking screw 264 to lift the lower shaft portion 264 above the hook 262A, the top of the shutter 112 may be pivoted outward, as shown in FIG. 17 and then lifted off the lower mounting assemblies 230 and removed.

As the locking screw 264 extends upward to disengage from the hook 262A, the upper mounting assemblies 250 cannot be used for the uppermost niches 110 directly below the cover 106. As shown in FIGS. 14-17 and 20, the uppermost shutter mounting assemblies 270 must be used for the uppermost niches 110 directly under the cover 106. The uppermost shutter mounting assemblies avoid having a member extend upward an impinge on an underside of a cover 106. Therefore, the underside of the cover or capstone 106 may be continuously planar without a channel or notch being formed to accommodate a raised threaded member.

Figure 18:
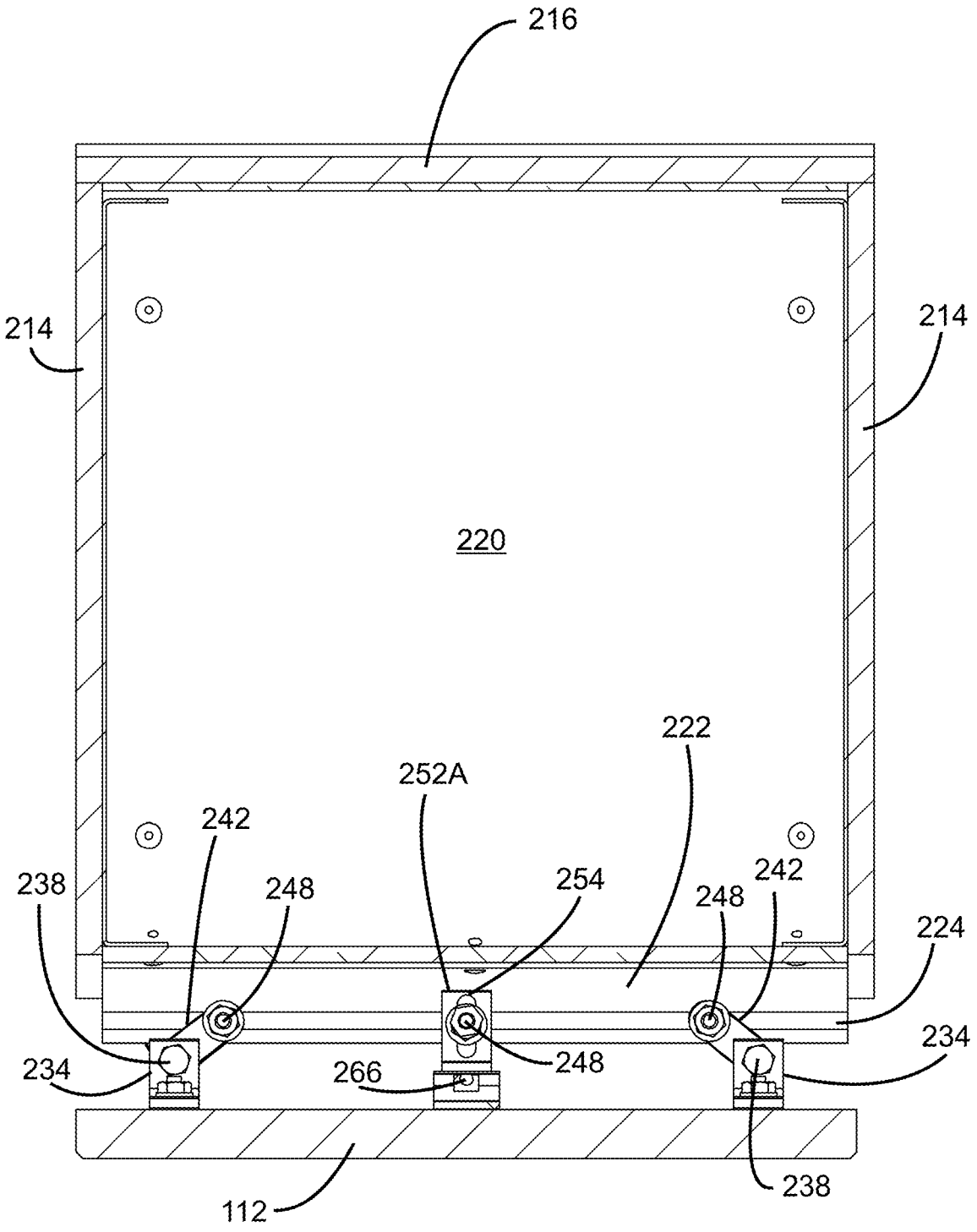
FIG. 18 is a top sectional view of the shutter and the lock hardware taken along line 18-18 of FIG. 16.
Figure 21:
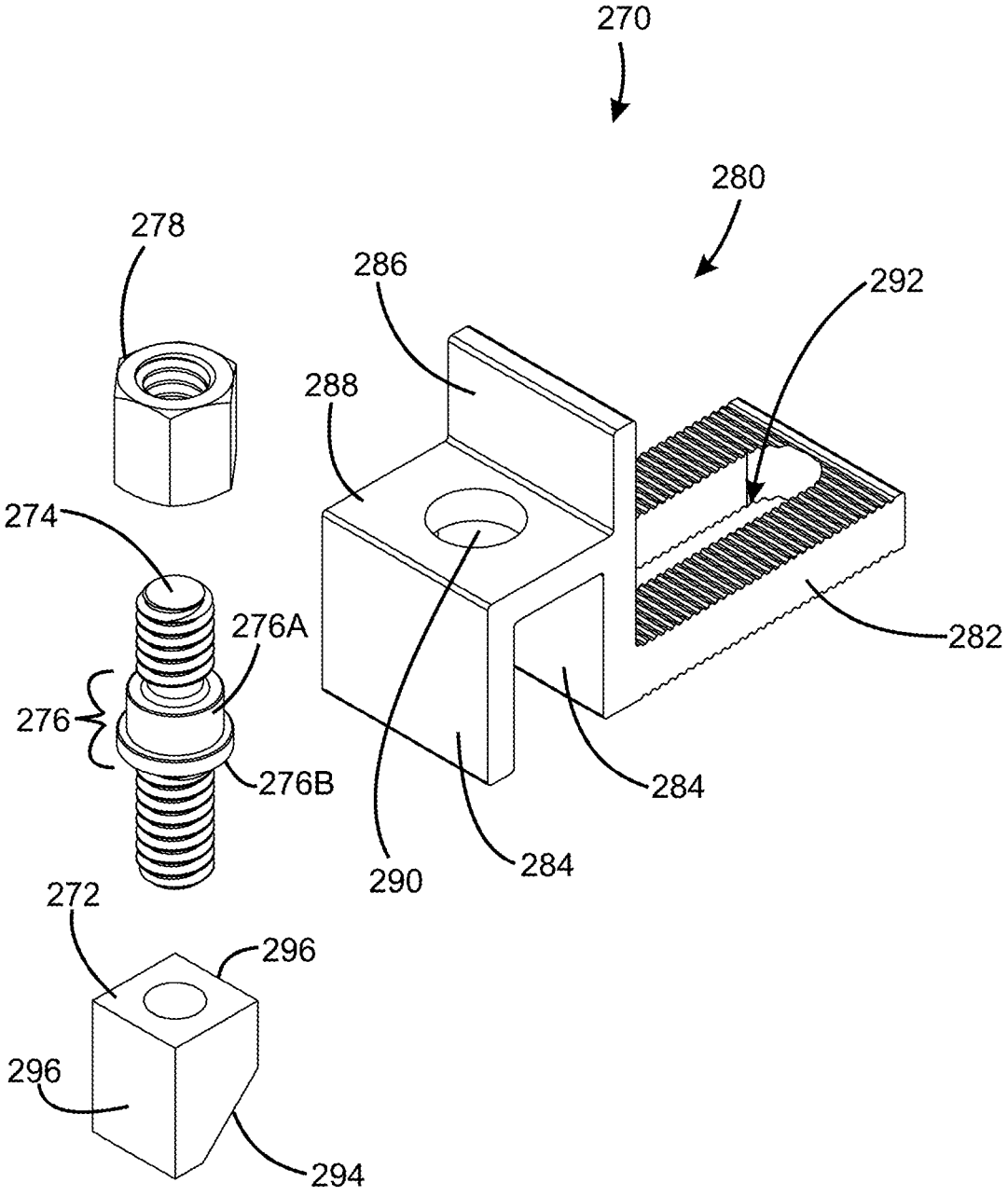
FIG. 21 is an exploded perspective view of the lock elements for the shutter mounting system shown in FIG. 14.

Referring to FIG. 21, the uppermost shutter mounting assembly 270 includes a support member 280. The support member 280 includes a rearward extending portion 282 having a slot 292 formed therein for receiving the lug 248, as shown in FIGS. 16-18. The rearward extending portion may include upper and/or gripping surfaces to help prevent elements slipping relative to one another. It can be appreciated that the lug 248 has a head fitting into the channel 224 of the front rail 222. However, for the uppermost shutter mounting assembly, the lug 248 extends downward through an orifice in the shelf front flange portion 222 and through the slot 292. In this manner, the support member 280 is mounted below the shelf front flange portion 222. A vertical portion 286 extends upward from a forward end of the rearward extending portion 282. A screw support portion 288 extends forward from the vertical portion. The screw support portion 288 includes an orifice 290. The support member 280 also includes a pair of parallel downward extending planar legs 284 extending downward from the screw support portion.

The uppermost shutter mounting assembly 270 also includes a threaded plunger 272. An uppermost locking screw 274 includes is configured to threadably engage the threaded plunger 272. The uppermost locking screw 274 includes a center collar portion 276 having a first portion 276A having a first diameter and a second portion 276B having a second diameter greater than the first diameter. The center collar portion 276 is configured so the first portion 276A may extend into the orifice 290, while the second portion 276B is wider than the orifice 290. A hex nut 278 threadably mounts to an upper end of the uppermost locking screw 274. Therefore, the uppermost locking screw 274 extends through the orifice 290 so the screw support portion 288 is retained between the hex nut 278 and the second wider portion 276B of the uppermost locking screw 274. The hex nut 278 is fixed to the uppermost locking screw 274 by welding, soldering, brazing, adhesive or other conventional attachment method.

The plunger 272 includes a lower angled surface 294. The plunger 272 is configured to extend below an upper end of the hook portion 262A when engaged, as shown in FIGS. 14, 16, 17 and 20. The angled surface 294 helps to guide the plunger 272 into the space behind the curved inner surface of the hook 262A. The plunger 272 includes planar front and rear faces 296. The plunger 272 is sized to fit between the legs 284, but is sufficiently wide that edges of the planar faces engage inner faces of the legs to block the plunger 272 from rotating relative to the legs 288.

The upper concealed mounting hardware assemblies 250 and 270 are accessed from outside the columbarium 100 with a flat wrench 1000 inserted through narrow horizontal space between adjacent shutters 112, such as shown in FIG. 19, or between the uppermost shutter 112 and the cover 106. When the upper shutter mounting assemblies 250 or the uppermost shutter mounting assemblies 270 are released, the shutter 112 may be pivoted outward about the lower shutter mounting assemblies 230, such as shown in FIG. 17. The shutter 112 may then simply be lifted off. To mount a shutter 112, the process is reversed. It is appreciated that the position of the shutter 112 may be adjusted by swiveling the hanger supports 242 to move the shutter inward, outward and laterally. The vertical position of the shutter 112 can be varied by adjusting the studs 238, and the locking screw 264 or uppermost locking screw 274. The locking screw 264 and the uppermost locking screw 274 are raised or lowered by engaging the associated nut with the wrench and turning in the appropriate direction to raise or lower.

Figure 14:
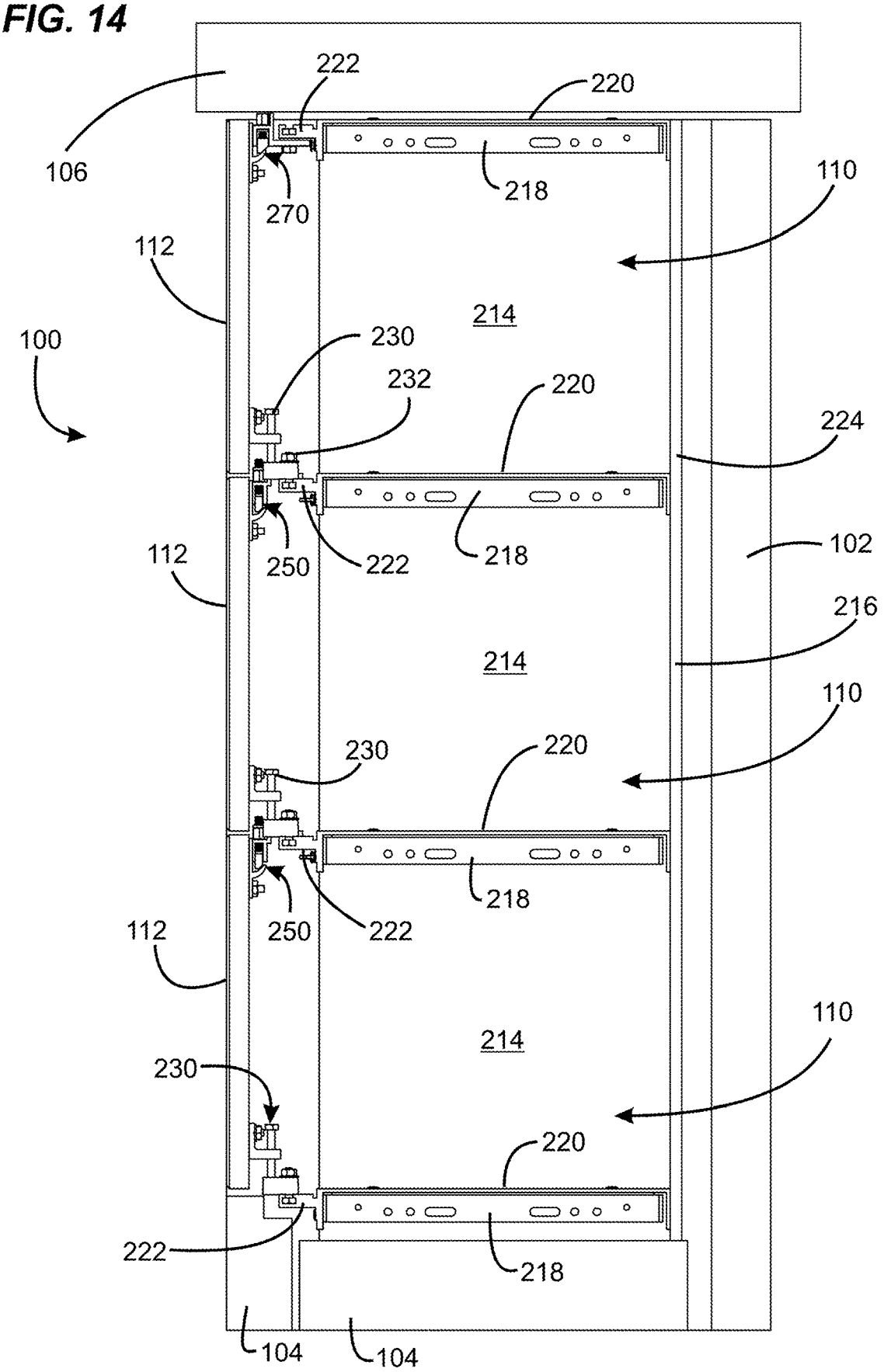
FIG. 14 is a side sectional view of a second embodiment of the columbarium shown in FIG. 1.
Figure 15:
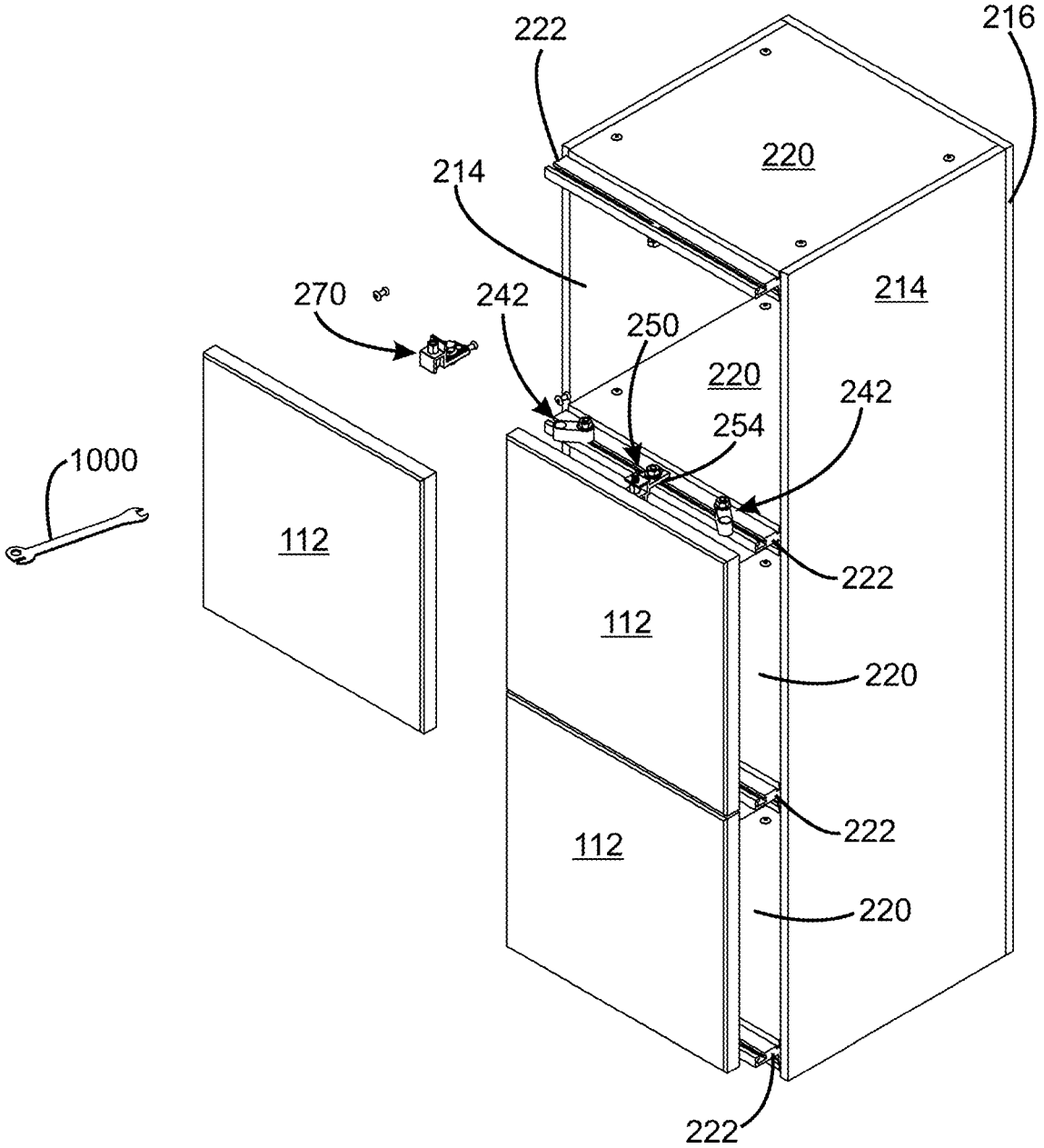
FIG. 15 is a partially exploded view of a column of niches for the columbarium shown in FIG. 14.

It is appreciated that the uppermost shutter mounting assembly 270 provides for engagement of the hex nut 278 by the wrench 1000 and turning clockwise or counterclockwise to rotate the uppermost locking screw 274. The uppermost locking screw does not rise or fall as it is held vertically by the collar portion 276B and hex nut 278 positioned above and below the screw support portion 288. Therefore, no notches or channels need be formed in the underside of the cover 206 and manufacture is simplified. Although the uppermost locking screw 274 does not rise and fall, rotation of the uppermost locking screw causes it to rotate relative to the threaded plunger 272. As the plunger 272 is blocked from rotation relative to the legs 284, the plunger 272 travels axially along the uppermost locking screw 274 when the uppermost locking screw 274 rotates, thereby causing the plunger 272 to rise or fall. The plunger 272 is raised and retracted toward the screw support portion 288 for removal or before mounting, as shown in FIG. 17. To lock the shutter 112 in place, the uppermost locking screw 274 is rotated so that the plunger 272 travels lower along the uppermost locking screw 272 to an engagement position with hook portion 262A, as shown in FIGS. 14 and 16. In either configuration, the screw 274 and hex nut 278 remain at the same elevation.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A columbarium comprising:

a plurality of niches, each niche comprising a horizontal panel forming one or both of a top and a bottom of the niche;

a plurality of shutters mounting in front of the niches, each of the shutters having an outer face and an inner face;

a shutter mounting system for mounting a shutter over one or more niches, the shutter mounting system comprising:

a flange extending outward from an outer edge of the horizontal panel of each niche, the flange having a channel formed therein extending parallel to the outer edge of the horizonal panel;

an upper shutter mounting assembly attached to the inner face of the shutter, the upper shutter mounting assembly comprising an upper mounting bracket attached to the inner face of the shutter to support an upper engagement element to engage a channel in a flange of an adjacent higher niche;

an upper complementary mounting assembly including a support member;

wherein the upper mounting bracket includes lateral retaining side wall portions extending inward toward the niche, and wherein the support member of a complementary mounting assembly is confined between the side wall portions to prevent lateral movement of the shutter;

two or more spaced apart lower shutter mounting assemblies, each of the lower shutter mounting assemblies having a lower engagement element, and a lower mounting bracket attached to the inner face of the shutter to support the lower engagement element to extend into the channel in the flange of the niche;

wherein the upper mounting bracket is laterally intermediate the lower mounting brackets.

2. The columbarium according to claim 1, wherein the engagement elements comprise bolts.

3. The columbarium according to claim 1, wherein the mounting brackets comprise a longitudinal slot extending substantially horizontally transverse to the inner face of the shutter.

4. The columbarium according to claim 1, wherein mounting brackets comprise a slot for adjusting a distance of the engagement elements from the shutter.

5. The columbarium according to claim 1, wherein engagement elements are adjustably mounted to the mounting brackets to horizontally adjust the engagement elements.

6. The columbarium according to claim 1, wherein the columbarium is free of swivel sockets; and wherein the lower mounting bracket comprises an L-shaped bracket with a threaded stud extending through a threaded orifice in a projecting leg of the L-shaped bracket, the threaded stud resting directly in the channel of the flange.

7. A shutter mounting system for mounting a shutter over at least one niche, the shutter having an outer face and an inner face; the niche comprising a horizontal panel forming one or both of a top and a bottom of the niche; the shutter mounting system comprising:

a flange extending outward from an outer edge of the horizontal panel of each niche, the flange having a channel formed therein extending parallel to the outer edge of the horizonal panel;

an upper mounting assembly attached to the inner face of the shutter, the upper mounting assembly comprising an upper mounting bracket attached to the inner face of the shutter to support an upper engagement element to engage a channel in a flange of an adjacent higher niche;

an upper complementary mounting assembly including a support member; wherein the upper mounting bracket includes lateral retaining side wall portions extending inward toward the niche, and wherein the support member of a complementary mounting assembly is confined between the side wall portions to prevent lateral movement of the shutter;

two or more spaced apart lower mounting assemblies, each of the lower mounting assemblies having a lower engagement element, and a lower mounting bracket attached to the inner face of the shutter to support the lower engagement element to extend into the channel in the flange of the niche;

wherein the upper mounting bracket is laterally intermediate the lower mounting brackets elements.

8. The shutter mounting system according to claim 7, wherein the engagement elements comprise bolts.

9. The shutter mounting system according to claim 7, wherein the mounting brackets comprise a longitudinal slot extending substantially horizontally transverse to the inner face of the shutter.

10. The shutter mounting system according to claim 7, wherein mounting brackets comprise a slot for adjusting a distance of the engagement elements from the shutter.

11. The shutter mounting system according to claim 7, wherein engagement elements are adjustably mounted to the mounting brackets to horizontally adjust the engagement elements.

12. The shutter mounting system according to claim 7, wherein the columbarium is free of swivel sockets; and wherein the lower mounting bracket comprises an L-shaped bracket with a threaded stud extending through a threaded orifice in a projecting leg of the L-shaped bracket, the threaded stud resting directly in the channel of the flange.

13. A columbarium comprising:

a plurality of niches, each niche comprising a horizontal panel forming one or both of a top and a bottom of the niche;

a plurality of shutters mounting in front of the niches, each of the shutters having an outer face and an inner face;

a first shutter mounting system for mounting a shutter over one or more niches, the shutter mounting system comprising:

a flange extending outward from an outer edge of the horizontal panel of each niche, the flange having a channel formed therein extending parallel to the outer edge of the horizonal panel;

an upper mounting assembly attached to the inner face of the shutter, the upper mounting assembly comprising an upper mounting bracket attached to the inner face of the shutter to support an upper engagement element to engage a channel in a flange of an adjacent higher niche;

two or more spaced apart lower mounting assemblies, each of the lower mounting assemblies having a lower engagement element, and a lower mounting bracket attached to the inner face of the shutter to support the lower engagement element to extend into the channel in the flange of the niche;

wherein the upper mounting bracket is laterally intermediate the lower mounting brackets;

a second shutter mounting system for mounting a shutter over at least a topmost niche, the second shutter mounting system comprising:

an upper lock assembly comprising:

a threaded element including a radially outward extending protrusion;

a nut fixed to the threaded element above the protrusion;

a plunger configured to engage a complementary element on the shutter;

a bracket comprising:

a mounting portion mounting to the columbarium;

a supporting portion having a vertical orifice receiving the threaded element and supporting the threaded element oriented substantially vertically;

an anti-rotation portion extending downward from the supporting portion, the plunger engaging the anti-rotation portion to block rotation of the plunger;

wherein the threaded element includes a center collar portion having a first portion with a first diameter and a second portion with a second diameter greater than the first diameter, wherein the screw support portion is retained between the nut and the second portion of the collar portion so that the threaded element does not rise or fall relative to the bracket during rotation; and wherein rotation of the threaded element causes the plunger to travel axially along the threaded element to raise or lower the plunger while the threaded element remains at a constant vertical position.

* * * * *